United States Patent [19]

Quenneville

[11] 4,360,157

[45] Nov. 23, 1982

[54] PLURAL COMPONENT SYSTEM

[76] Inventor: Marc A. Quenneville, 8976-69th St. N., Pinellas Park, Fla. 33565

[21] Appl. No.: 189,716

[22] Filed: Sep. 22, 1980

[51] Int. Cl.[3] ..... B05B 7/04; B05B 9/04

[52] U.S. Cl. ..... 239/61; 239/304; 239/310; 239/428

[58] Field of Search ..... 239/61, 93, 94, 99, 239/101, 124, 127, 310, 303-305, 330, 398, 407, 428, 412-414, 525-527, 569, 570; 137/87, 99; 222/134; 417/472-474, 479

[56] References Cited

U.S. PATENT DOCUMENTS 2,819,928 1/1958 Liedberg ..... 239/304
3,008,808 11/1961 Hodges ..... 239/407 X
3,097,764 7/1963 Loeser ..... 239/304 X
3,765,605 10/1973 Gusmer et al. ..... 239/61
3,829,016 8/1974 Scharfenberger ..... 239/127

*Primary Examiner*—Johnny D. Cherry
*Attorney, Agent, or Firm*—Ronald E. Smith

[57] ABSTRACT

Apparatus for applying plural components to a work surface. One embodiment contemplates the application of a primarily resinous solution having an operative amount of catalyst admixed therewith. Another embodiment contemplates the application of an epoxy comprising substantially equal parts of resin and catalyst. The apparatus segregates the operating fluid from the components being pumped so that an epoxy may follow or be preceded by an application of polyester resin, in the absence of apparatus cleaning or flushing between applications.

10 Claims, 5 Drawing Figures

10
12
13
16
18
19
21
34
36
37
38
39
40
42
44
46
47
48
49
51
52
54
56
58
59
60
62
64
66
68
69
71

PLURAL COMPONENT SYSTEM

BACKGROUND OF THE INVENTION

1. Field of the Invention

This invention relates generally to apparatus useful for applying plural components to a work surface, and more specifically relates to an apparatus having the capability of applying different components to a work surface in successive applications without requiring the apparatus to be cleaned between applications of differing components.

2. Description of the Prior Art

Existing plural component devices must be cleaned when changing from the application of, e.g., epoxy to polyester resin or vice versa. The cleaning requirement arises from the provision in earlier systems of pumps that pump the component or catalyst through the operative chambers of the pumping means itself. Thus, not only must such a pump be thoroughly flushed with a solvent, such as acetone, when changing from one application to another, but such pumps routinely develop leaks that endanger both equipment and personnel operating the equipment.

These earlier systems also rely on pressure pots to carry the catalyst, in polyester resin applications, to the plural component gun. Thus, the catalyst must be transferred from its shipping container to the pressure pot, even though such catalyst is highly reactive. Further, such pressure pots are unable to de-clog the catalyst line to the gun if the line should clog. Earlier systems also lack means for abruptly activating or de-activating the gun, with the result that many guns of the prior art continue to spray components onto a work surface even after the gun has been de-activated.

SUMMARY

The inherent deficiencies of earlier systems are overcome by an apparatus that provides a working fluid segregated from the fluid being pumped and supplied to the plural component applicator, whether such applicator be of the spray gun type or of the roller type. The separation of the fluids is accomplished by use of bladder-type pumps, which are known in other environments. The use of such pumps in the environment of a plural component apparatus was heretofore unknown, and the unexpected results flowing from such use in such an environment are altogether synergistic. The bladders form a component passageway that need not be cleaned when changing from one component to another. The changeover from one component to another is also easily accomplished by simply changing component reservoirs. The catalyst, supplied in small quantities in polyester resin applications, is pumped from its shipping container, thus reducing the amount of handling of that dangerous substance. The same operative force for pumping the components is harnessed for pumping the catalyst, in that a reciprocating piston acts on the bladders through an operating fluid and also provides a linearly reciprocating gear means for driving the catalyst pump. The catalyst pump provides sufficient pressure to drive out any clogs that may appear in the catalyst supply line to the gun, in polyester resin applications. An air operated solenoid valve disposed between the main air supply for the system provides a means whereby the apparatus responds promptly to activation and de-activation signals, as opposed to the sluggish response inherent in earlier systems.

It is therefore seen to be an important object of the invention to provide a plural component apparatus that need not be cleaned when changing from an epoxy to a polyester resin application.

A closely related object is to provide such an apparatus that can changeover from an application of an epoxy to a polyester resin by the interchange of reservoirs alone.

Another object is to provide such an apparatus usable either with a spray gun apparatus or a roller-type apparatus.

Still another object is to provide a system that can supply catalyst to a gun, in polyester resin applications, directly from the catalyst storage container, thereby obviating the need to transfer the contents of the storage container to a pressure pot.

yet another object is to eliminate the use of pressure pots to not only reduce the handling of catalyst, but to further enable the catalyst supply line to a gun to be unclogged as needed.

Yet another object is to provide a solenoid valve means for crisp activation and de-activation of a plural component apparatus.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
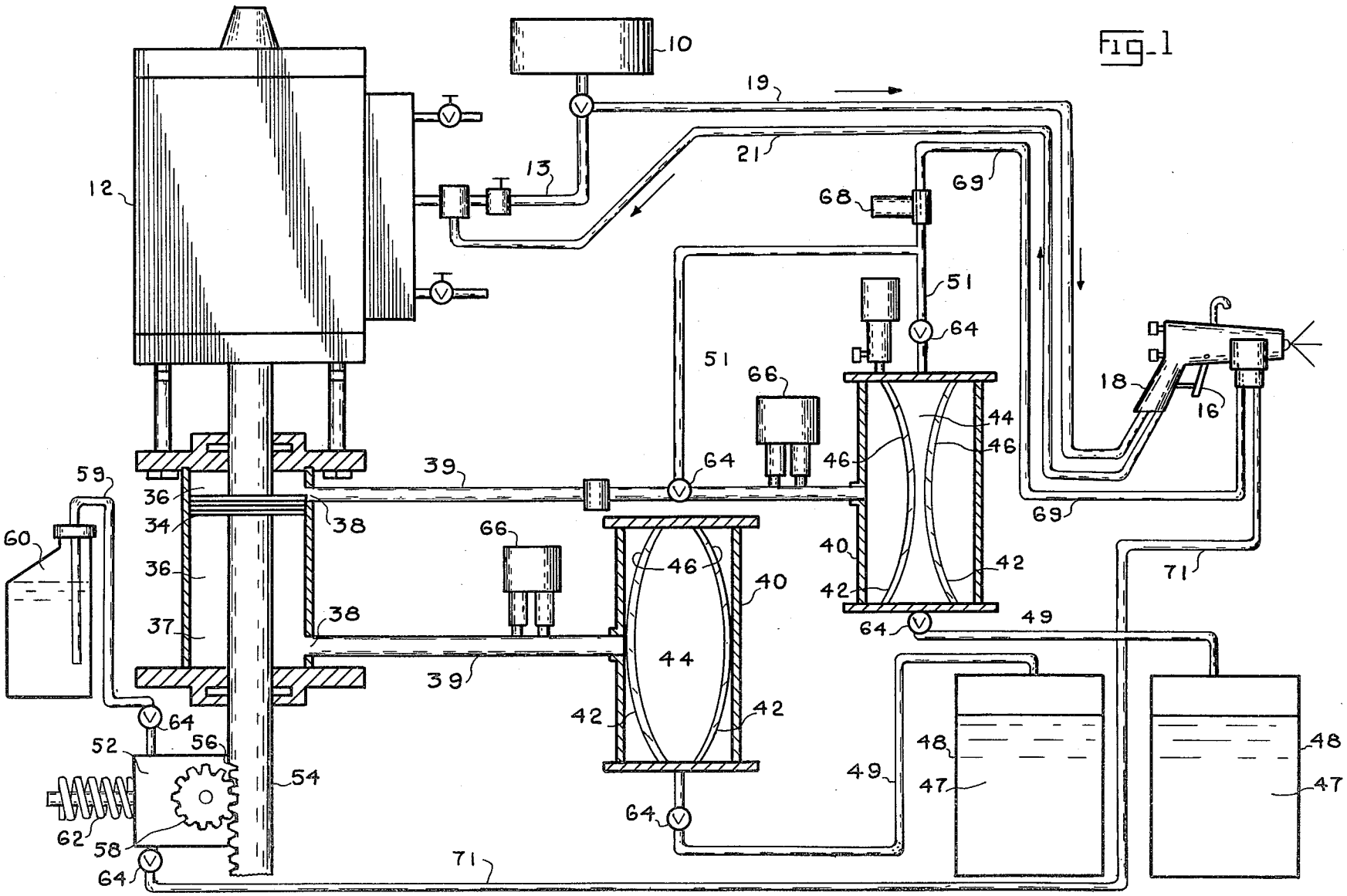
FIG. 1 is a schematic of the preferred embodiment of the invention.
Figure 1A:
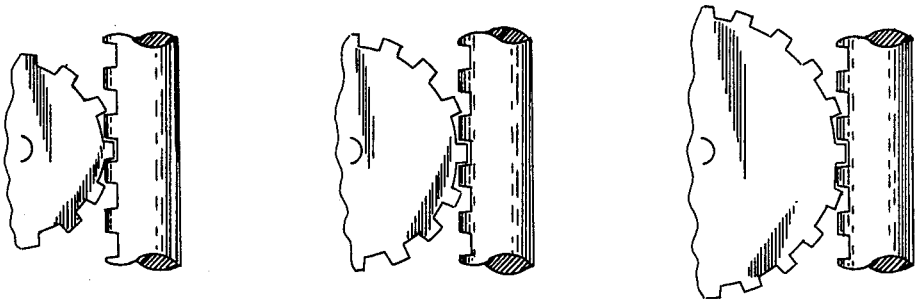
FIG. 1A shows a plurality of pinion gears of differing sizes of the type used to change the ratio of components being applied as desired.
Figure 2:
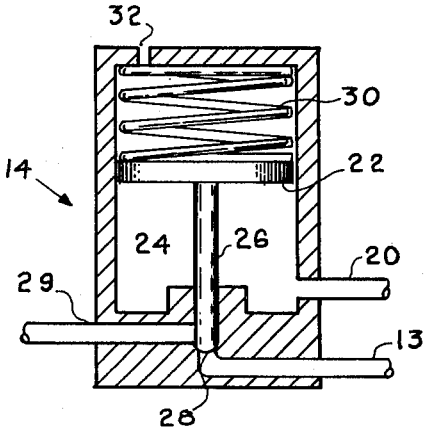
FIG. 2 is a longitudinal sectional view of the novel solenoid valve means.

Referring now to FIG. 1, an air compressor 10 is shown delivering air under pressure to a double-acting air cylinder 12 via main supply line 13.

A solenoid valve, generally designated 14 is positioned in main supply line 13 and operates to activate and de-activate the double-acting air cylinder 12 responsive to activation and de-activation, respectively, of a spring loaded trigger means 16 associated with an airless gun 18. Depressing the trigger means 16 opens a valve means (not shown) in a pilot air line that has a supply portion 19 in fluid communication with the air compressor 10 and the gun 18, and a return portion 21 in fluid communication with the solenoid valve 14 and the airless gun 18. Thus, depressing the trigger means 16 allows compressed air to enter the solenoid valve means 14 as at 20 via supply line 19, through the valve means (not shown) disposed interiorly of the gun 18 and operatively connected to the trigger means 16, and hence through return line 21. The air under pressure entering the solenoid valve means 14 as at 20 effects the sliding displacement of a piston means 22 slidingly received within a piston chamber 24. Such displacement of the piston means 22 in turn causes the withdrawal of piston 26 from its seated position as at 28 in the passageway 29 of the main supply line 13, thereby admitting air under pressure into the double-acting air cylinder 12. A suitable bias mechanism 30 urges the piston means 22 and its associated arm 26 to re-assume their equilibrium position when said trigger means 16 is released, thereby closing main supply line 13. A vent means 32 prevents neutralizing air pressure build up behind the piston means 22.

Compressed air, admitted to the double-acting cylinder 12 in the manner just described, imparts a reciprocal motion to another piston means 34 slidingly received within a piston-receiving chamber 36 filled with a suitable operating fluid, such as conventional hydraulic fluid 37. A pair of spaced apertures 38, 38 are provided, disposed one each substantially adjacent the opposing ends of the piston-receiving chamber 36 so that the reciprocal motion of the piston means 34 in the chamber 36 causes the hydraulic fluid 37 in the chamber 36 to exit the chamber 36 first through one aperture 38 and then through the other aperture 38 in continual alternating sequence. As the piston means 34 propels a predetermined quantity of hydraulic fluid 37 through one of the apertures 38, a like amount of hydraulic fluid 37 is substantially simultaneously pulled into the chamber 36, through the other aperture 38 responsive to the travel of the piston means 34. The apertures 38, 38 are in fluid communication, through tubular members 39, 39 with a pumping chamber 40 individual to each aperture 38, 38.

A pair of substantially flexible bladders 42, 42 are disposed interiorly of each pumping chamber 40, 40, in transversely spaced-apart relation, and collectively define a fluid impervious component pumping channel 44 therebetween. Thus, hydraulic fluid 37 is disposed in surrounding relation to the bladders 42, 42, impinging only upon the rearward surfaces 46, 46, of the bladders 42, 42. In this manner, segregation of the hydraulic fluid 37 and the components 47, 47 is achieved.

The components 47, 47 are stored in reservoirs 48, 48, and each reservoir 48 is in fluid communication with the component passageway 44 defined by the bladders 42 via lines 49, 49.

Accordingly, the reciprocal motion of the piston means 34 causes one pair of bladders 42 to converge while the other pair of bladders 42 diverge relative to each other, as depicted in FIG. 1. The components 47, 47 are therefore pumped from their respective reservoirs 48, 48, due to the action of the bladders 42, 42, through component passageways 44, 44 via lines 49, 49 and to the airless gun 18 via lines 51, 51.

It will now be appreciated that an important object of the invention is achieved due to the segregation of the hydraulic fluid 37 and the components 47, 47. In earlier devices, the components are pumped directly through the pumping means, as aforesaid, which necessitates the cleaning or flushing of the pumping means when changing from one component to another.

More specifically, the object of providing an apparatus useful for applying both epoxy and resin in successive applications is achieved by providing the apparatus herein described, since one of the reservoirs 48 may contain a catalyst while the other reservoir 48 may contain a polyester resin. Since epoxy comprises a 1:1 ratio of resin and catalyst, it is clear that the apparatus just described provides a unique method of applying epoxy to a work surface. If an application of polyester resin is to follow an application of epoxy, a resin reservoir simply replaces the catalyst reservoir of the epoxy system, since an application of polyester resin comprises approximately 100 parts of resin to 1 part of catalyst.

The required catalyst in polyester resin applications is also supplied by a novel means. The reciprocating motion of the piston means 34 that acts on the bladders 42, 42 through the hydraulic fluid 37 is harnessed to drive a catalyst pump 52. Specifically, the rod 54 of the piston 34 protrudes from the piston chamber 36 and comprises a rack means 56 for meshing engagement with a pinion means 58 operatively connected to the catalyst pump 52, which in turn is in fluid communication via line 59 with catalyst reservoir 60. The pinion means 58 is held into meshing engagement with the rack means 56 by means of a suitable bias mechanism as at 62. To change the ratio of the catalyst to the resin, it is necessary to simply change the size of the pinion means 58 as desired.

This novel arrangement permits the user of the apparatus to place catalyst line 59 directly into the manufacturer's container for the catalyst, thus eliminating the need for transferring the catalyst from its shipping container to a different reservoir, as in earlier systems. Since the catalyst is normally the highly explosive methyl ethel ketone peroxide, handling the catalyst more than is absolutely necessary is contraindicated.

A plurality of check values, collectively designated 64, prevent reverse flow of catalyst and resin. Further, pressure relief valves 66, 66 prevent excessive pressure build up in the hydraulic fluid system. A filter means 68 is also provided in line 69 to provide gun 18 with a substantially impurity-free flow of components.

Although pneumatic-means have been described as providing the motive force for the inventive apparatus, it is clear that electrical motors or motors of other types could also be used to import reciprocating motion to the piston means 34. However, pneumatic means are preferred due to the highly reactive nature of the substances handled by the apparatus. Another desirable feature of the inventive apparatus, demonstrative of synergism, lies in the ability of the catalyst pump 52 to unclog the substantially non-collapsible catalyst line 71 by providing sufficient pressure to do so. Earlier devices, which rely on a pressure pot (the transfer of catalyst to which from the manufacturer's container is contraindicated as aforesaid) to supply the catalyst to the airless gun, are rendered inoperative when a clog appears in the catalyst line to the gun.

Airless guns of the type illustrated are normally used in polyester resin applications whereas epoxy applications normally call for the use of a roller-type applicator, not shown.

ALTERNATIVE EMBODIMENTS

Figure 3:
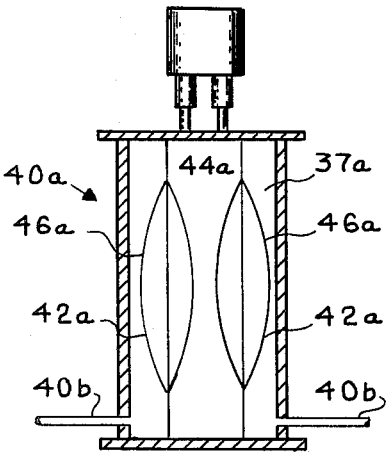
FIG. 3 is a schematic view of an alternative form of pumping chamber.

FIG. 3 shows an alternative pumping chamber 40*a* having a central component passageway 44*a* interposed between opposing sets of bladders 42*a*. The hydraulic fluid 37*a* enters the pumping chamber 40*a* as at 40*b*, 40*b*, i.e., outwardly of the bladder sets 42*a* so that the fluid 37*a* impinges only upon the outward or rearward surfaces 46*a* of each bladder 42*a*. This arrangement of parts combines the separate pumping chambers 40, 40 of the first-described embodiment into one pumping chamber 40*a*, while maintaining the ability to handle succesive applications of polyester resin or epoxy, without any need for flushing the system when changing from the application of one to the other.

Figure 4:
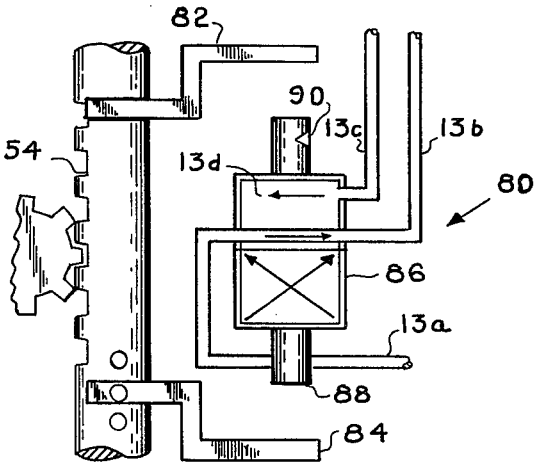
FIG. 4 is a schematic representation of an alternative mechanism for operating the double acting air cylinder of the invention.

FIG. 4 shows an improved means for operating the double-acting air cylinder 12. A directional valve, generally designated 80, is disposed between the pilot operated shut off valve 14 and the cylinder 12. A pressure regulator, not shown, is further disposed between the shut off valve 14 and the directional valve 80.

Air ultimately from the air compressor 10 enters the valve 80 and is alternately directed, in continuous sequence attendant operation of the system, into the cylinder 12 on opposite sides of the piston means (not shown) that is slidingly disposed therein. As compressed air impinges upon one face of said piston means, the valve 80 allows air on the other side of the piston to be bled into the atmosphere.

More specifically, air entering the valve 80 via line 13*a* may first enter the lower half of the cylinder 12 via line 13*b*, thereby driving the piston, not shown, upwardly. Simultaneously, line 13*c* bleeds air in the upper half of the cylinder 12 to atmosphere as at 13*d*. On the next cycle, air enters the upper half of the cylinder 12 through line 13*c*, and air is bled from the lower half of the cylinder 12 via line 13*b*, and expelled to atmosphere again as at 13*d*.

As shown in FIG. 4, the directional valve 80 is mounted to communicate with and to thereby be activated by the reciprocating motion of the piston rod 54. Specifically, the valve 80 is activated, in a manner to be described, upon contact with a pair of stop members 82, 84, fixedly secured to and carried by the piston rod 54. The valve 80 includes a sliding spool portion 86 that is fixedly secured, but moveable relative to a spindle portion 88. A downward movement of the piston rod 54 effects the engagement of upper stop 82 and the spindle 88, thereby driving the spindle 88 downwardly. The spindle 88 is then driven upwardly by lower stop 84. The spool portion 86 therefore slides relative to the spindle 88 and effects the desired valving operation. A dent control means 90 is also provided to maintain the position of the spindle when it is not being acted upon by either stop 82, 84.

The upper stop 82 has a plurality of positions of functional adjustment in a vertical plane, so that the length of the piston 34 stroke may be adjusted. (I.e., raising the upper stop 82 would increase the throw of the piston 34). In this manner, the pumping ratios of the inventive system can easily be altered.

It will thus be seen that the objects set forth above, and those made apparent from the preceding description, are efficiently attained, and since certain changes may be made in the above construction without departing from the scope of the invention, it is intended that all matters contained in the above description or shown in the accompanying drawings shall be interpretated as illustrative and not in a limiting sense.

It is also to be understood that the following claims are intended to cover all of the generic and specific features of the invention herein described, and all statements of the scope of the invention which as a matter of language, might be said to fall therebetween.

Now that the invention has been described, what is claimed is:

1. An apparatus for supplying plural components to a device for applying said plural components to a work surface, comprising, at least a pair of component reservoirs, at least two component pumping chambers of like pumping capacity and releasably connected between said component reservoir and a device for applying plural components to a work surface so that both of said component pumping chambers can be connected between a common reservoir and said device or between said device and a reservoir individual to each of said component pumping chambers.

at least one catalyst reservoir, at least one catalyst pumping means operatively and releasably connected between said catalyst reservoir and said device for applying plural components, means for controlling the ratio of the amount of catalyst, pumped from said catalyst reservoir to said device, to the amount of components pumped from said component reservoir to said device by said pumping chambers of like capacity, each of said component pumping chambers having a pair of opposed, spaced-apart, substantially flexible bladders disposed therein, said bladders dividing each of said component pumping chambers into a component passageway therebetween and an operating fluid chamber therebeyond, reciprocating means for increasing the amount of operating fluid in one of said operating fluid chambers while substantially simultaneously decreasing the amount of operating fluid in the other of said operating fluid chambers on a sequentially continuous, alternating basis so that one pair of opposed bladders responds to an increased amount of operating fluid surrounding said bladders by being convergingly displaced relative to each other while the other pair of said bladders are divergingly displaced relative to each other, responsive to the decrease in the amount of surrounding operating fluid, said reciprocating means further operatively connected to said catalyst pumping means so that the reciprocating motion of said reciprocating means operates said catalyst pumping means, whereby said apparatus has the flexibility to provide at least three different ingredients to said plural component device, wherein two of said components are provided to said device in substantially equal amounts, and wherein a third catalyst ingredient is provided to said device at a predetermined ratio relative to said first two components, and, whereby disconnecting said catalyst reservoir from said plural component device provides an apparatus for delivering two different components to said plural component device in substantially equal quantities in the absence of said catalyst, and disconnecting one of said component reservoirs from said apparatus provides an apparatus for delivering a single component through both of said component pumping chambers to said plural component device and, whereby the segregation of said component pumping chambers and said operating fluid chambers and the provision of multiple reservoirs obviates the need to clean said component pumping chambers when changing from the application of a singular component to the application of plural components.

2. The apparatus of claim 1, wherein the reciprocating means comprises a double-acting air cylinder that includes a double acting piston means disposed in a piston-receiving chamber having at least two longitudinally spaced outlets, each outlet in fluid communication with one of said component pumping chambers.

3. The apparatus of claim 2, wherein said piston means is carried by an elongate piston connecting rod, the distal end of which projects outwardly from said piston-receiving chamber, a plurality of linearly aligned gear teeth formed on said distal end of said connecting rod thereby providing rack means for engaging pinion gear means operatively connected to said catalyst pumping means so that the reciprocating motion of said rack means causes said pinion gear means to rotate first in one operative direction and next in the opposite operative direction in continuous sequence, thereby driving said catalyst pumping means.

4. The apparatus of claim 3, wherein bias means constrains said pinion gear means and said associated catalyst pumping means to bear against said reciprocating rack means.

5. The apparatus of claim 4, wherein pinion gear means of differing predetermined sizes are provided so that the amount of catalyst being pumped by said catalyst pumping means is changed when pinion gear means of differing sizes are employed.

6. The apparatus of claim 2, wherein means are provided for supplying a gasous fluid under pressure to said double-acting air cylinder for imparting the reciprocating motion to said piston means.

7. The apparatus of claim 6, wherein said means for supplying gasous fluid under pressure comprises an air compressor.

8. The apparatus of claim 7, wherein said device for applying plural components to a work surface further comprises means for activating and de-activating said reciprocating means.

9. The apparatus of claims 8, wherein said activating and de-activating means comprises a pilot air line in fluid communication between said air compressor and said plural component device, a second air line in fluid communication with said plural component device and a solenoid valve means, and a spring-loaded trigger-operated valve means disposed between said pilot air line and said second air line so that opening said trigger operated valve means by depressing a trigger means provides airflow from said air compressor, through said trigger operated valve means and to said solenoid valve means.

10. The apparatus of claim 9, wherein said solenoid valve means comprises a piston-receiving chamber having a complementally formed piston means slideably received therein, said last-mentioned piston means carried by a connecting rod that projects outwardly of said last-mentioned piston-receiving chamber, said solenoid valve means further comprising an air passageway extending therethrough adjacent said last-mentioned piston-receiving chamber, said last-mentioned piston means biased so that said connecting rod bars the flow of compressed air through said air passageway, said second air line in fluid communication with said last-mentioned piston-receiving chamber so that depressing said trigger means admits compressed air into said last-mentioned piston-receiving chamber and acts against the bias means so that said piston carrying connecting rod is urged to withdraw from its passage-blocking disposition, thereby admitting compressed air into said double-acting air cylinder only when said trigger means is depressed.

* * * * *